US009333671B2

(12) United States Patent
Huhtala et al.

(10) Patent No.: US 9,333,671 B2
(45) Date of Patent: May 10, 2016

(54) CHOPPING AID DEVICE

(71) Applicant: Fiskars Brands Finland Oy Ab, Billnäs (FI)

(72) Inventors: Juha Huhtala, Karjaa (FI); Mikko Heine, Helsinki (FI); Teemu Sandelin, Helsinki (FI)

(73) Assignee: Fiskars Brands Finland Oy Ab, Billnäs (FI)

( * ) Notice: Subject to any disclaimer, the term of this patent is extended or adjusted under 35 U.S.C. 154(b) by 91 days.

(21) Appl. No.: 14/133,132

(22) Filed: Dec. 18, 2013

(65) Prior Publication Data

US 2014/0175724 A1 Jun. 26, 2014

(30) Foreign Application Priority Data

Dec. 20, 2012 (FI) ..... 20126351

(51) Int. Cl.
*B27L 7/08* (2006.01)
*B27L 7/00* (2006.01)

(52) U.S. Cl.
CPC .... *B27L 7/00* (2013.01); *B27L 7/08* (2013.01)

(58) Field of Classification Search
CPC .... B27B 29/08; B27B 29/00; B27B 17/0041; B27B 7/00; B27B 7/08; A47J 43/18
USPC ..... 269/15, 53, 54.1, 54.2, 54.3
See application file for complete search history.

(56) References Cited

U.S. PATENT DOCUMENTS

| | | | | | |
|---|---|---|---|---|---|
| 1,026,721 | A | * | 5/1912 | Thomas | 269/54.3 |
| 1,117,412 | A | * | 11/1914 | Lynch | 294/5 |
| 1,149,525 | A | * | 8/1915 | Kennedy | 269/54.3 |
| 1,156,510 | A | * | 10/1915 | Welz | 269/90 |
| 1,203,256 | A | * | 10/1916 | Peterson | 269/53 |
| 1,257,587 | A | * | 2/1918 | Demuth | 269/54.3 |
| 1,289,848 | A | * | 12/1918 | Mainville | 269/54.3 |
| 1,309,396 | A | * | 7/1919 | Demuth | 269/54.3 |
| 1,418,213 | A | * | 5/1922 | Sviontek | 269/142 |
| 1,468,705 | A | * | 9/1923 | Hand et al. | 269/54.2 |
| 1,474,296 | A | * | 11/1923 | Shown | 269/54.1 |
| 1,513,853 | A | * | 11/1924 | Osborne | 269/54.2 |
| 1,558,325 | A | * | 10/1925 | Wood | 269/91 |

(Continued)

FOREIGN PATENT DOCUMENTS

| | | |
|---|---|---|
| CZ | 6499 | 9/1997 |
| DE | 32 02 062 | 8/1983 |

(Continued)

OTHER PUBLICATIONS

National Board of Patents and Registration of Finland Search Report for Finland Application No. 20126351, dated Sep. 23, 2013, 1 page.

(Continued)

*Primary Examiner* — Lee D Wilson
*Assistant Examiner* — Jamal Daniel
(74) *Attorney, Agent, or Firm* — Foley & Lardner LLP

(57) ABSTRACT

A chopping aid device for use in chopping of firewood includes a frame to pre-vent pieces of wood from spreading into the surroundings outside the chopping aid device during chopping. In order to make chopping of wood easy, fast and safe, the chopping aid device has a support with flexible spikes to keep the firewood in an upright position within the frame.

20 Claims, 3 Drawing Sheets

(56) References Cited

U.S. PATENT DOCUMENTS

| | | | | | |
|---|---|---|---|---|---|
| 1,748,685 | A | * | 2/1930 | Streckfuss | 269/14 |
| 1,823,608 | A | * | 9/1931 | Kalkanis | 269/15 |
| 2,620,003 | A | * | 12/1952 | Perdue, Jr. | 269/15 |
| 2,688,353 | A | * | 9/1954 | Van Duyn | 269/53 |
| 2,751,951 | A | * | 6/1956 | Strathaus | 269/54.5 |
| 2,953,180 | A | * | 9/1960 | Kyles | 269/54.5 |
| 3,169,760 | A | | 2/1965 | Field | |
| 3,386,728 | A | * | 6/1968 | Smakel | 269/289 R |
| 4,235,428 | A | * | 11/1980 | Davis | 606/96 |
| 4,326,703 | A | * | 4/1982 | Marley | 269/156 |
| 4,468,018 | A | * | 8/1984 | Vaizey | 269/54.5 |
| 4,515,195 | A | | 5/1985 | Gladstein | |
| 7,731,074 | B2 | | 6/2010 | Martin et al. | |
| 2007/0029215 | A1 | | 2/2007 | Martinez et al. | |
| 2008/0073361 | A1 | | 3/2008 | Brouard | |
| 2010/0225039 | A1 | | 9/2010 | MacLean | |
| 2011/0049780 | A1 | | 3/2011 | Bowers | |
| 2012/0205376 | A1 | | 8/2012 | Yang et al. | |

FOREIGN PATENT DOCUMENTS

| | | |
|---|---|---|
| DE | 19703829 | 8/1998 |
| DE | 202004011826 | 12/2004 |
| DE | 1020040 63 195 | 7/2006 |
| EP | 1886779 | 2/2008 |

OTHER PUBLICATIONS

National Board of Patents and Registration of Finland Search Report for Finland Application No. 20126350, dated Sep. 18, 2013, 1 page.

US Office Action, U.S. Appl. No. 14/133,051 7 pages. (Aug. 28, 2015).

Office Action, U.S. Appl. No. 14/133,051, 8 pages (Mar. 11, 2016).

* cited by examiner

CHOPPING AID DEVICE

CROSS REFERENCE TO RELATED APPLICATIONS

This Application claims the benefit of priority to Finnish patent application No. 20126351, which was filed on Dec 20, 2012, the complete disclosure of which is incorporated by reference herein.

BACKGROUND OF THE INVENTION

The invention relates to a chopping aid device for use in chopping of firewood, the chopping aid device comprising a frame to prevent pieces of wood to spread into the surroundings outside the chopping aid device during chopping.

Such a chopping aid device is known from patent publication EP 1886779 B1. This known device in the form of a basket-like closed ring frame is designed to be mounted onto a chopping block and designed to prevent chopped wood to fall to the ground from the chopping block. By having this function, the chopping aid device provides at the same time for the user, and for people nearby the chopping aid device, safety in that chopped wood does not fly and hit the user or the people nearby. However, if the basket-like frame is not filled enough with chopping woods, the risk remains that the chopped wood flies over the ring frame. Further, the logs will easily turn to a position not being upright as a result of an incorrect hit with the axe. Still further, there is a risk of the axe bouncing pass the chopping block and hitting on the ground or on the knee/leg/foot of the person who is chopping.

Woods to be chopped shall be placed upright on the chopping block. This is not always easy. Especially if the wood to be chopped has a cut surface which is at an oblique angle in relation to the longitudinal axis of the wood to be chopped, the wood cannot be placed on the chopping block so that it remains upright without support. This problem, also present with the known chopping aid device of EP 1886779 B1, can be—provided the chopping block has an even planar upper surface and is not worn—solved by cutting off the inclined surface from the wood to be chopped and replacing the inclined surface with a surface which is perpendicular to the longitudinal axis of the wood to be chopped. Such a procedure is, however, time consuming and creates wood debris. Neither does it give the desired result if the chopping block has worn so that the upper surface thereof shows a concave form. Sometimes the problem with an oblique support area is solved by keeping the wood by hand in upright position and taking quickly the hand off the wood before hitting the wood with the axe. The wood must be hit immediately after the hand has been taken off the wood, because otherwise the wood turns horizontal making the chopping impossible. Such chopping is dangerous, difficult and time consuming. If the hand is not taken off the wood, there is an imminent possibility for injury. If the wood to be chopped is not split with one hit and the ring frame has not been fully filled with woods to be chopped, the wood will typically move within the ring frame in such a position that one must correct its position to enable a successful next hit with the axe. This is time consuming.

BRIEF DESCRIPTION OF THE INVENTION

An object of the invention is to provide a new chopping aid device, to be used for chopping firewood, which device generally makes chopping and splitting of logs easier, faster and safer. Justifiably the device could also be called a safety device.

The chopping aid device of the invention is characterized by a support comprising a plurality of flexible spikes to keep the firewood in an upright position within the cuff frame.

An essential idea of the invention is to use a plurality of flexible spikes, or the like, to keep the wood to be chopped upright within the frame of the device, the spikes (or the like) being adapted to support the wood laterally from its periphery and to keep the wood in place within the frame of the device. With the term "spike" is meant any type of longitudinal element, e.g. bristles providing the desired function.

Preferably the frame is a basket-like cuff frame comprising an upper edge whose distance from the bottom of the cuff frame is smaller at the front side or user side than the distance from the bottom at a side which differs from the front side. This prevents the handle of the axe from hitting the cuff frame when chopping.

Preferably the first ends of the spikes which are opposite to free ends of the spikes are attached to the cuff frame, whereby the spikes preferably are directed at least substantially horizontal within the cuff frame and preferably at an obtuse angle with respect a front-rear-line of the chopping aid device. Such arrangement of the spikes provides a good support for the woods and positively keeps the woods within the cuff frame. In such an arrangement preferably further the cuff frame is flexible and made of elastomeric material and the collar is made of harder material than the cuff frame. Such a selection of materials makes the chopping aid device durable: the collar prevents the blade of the axe to cut into the cuff frame, and the cuff frame prevents, by providing dampening properties, the collar from being damaged by the impact of the axe.

Preferably the spikes are detachably fastened to the collar. This makes replacement of worn or broken spikes easy.

In order to very effectively support plenty of woods, i.e. within the major area of the cuff frame, the spikes cover at least 70% of the cross-sectional area of the cuff frame.

Preferred embodiments of the chopping aid device according to the invention are disclosed in the attached claims.

The most important advantages of the chopping aid device according to the invention are that it makes chopping of wood easy, fast and safe. The chopping aid device allows to keep all sizes and shapes of woods upright all the time for more continuous splitting. The chopping aid device avoids the need for constant and cumbersome resetting of woods. Several woods or, if desired, only one wood, can be put into the chopping aid device at a time. The chopping aid device collects small debris from cutting making the splitting work less strenuous. The chopping aid device prevents the axe from bouncing astray during splitting and prevents woods from flying away.

BRIEF DESCRIPTION OF THE FIGURES

In the following the invention will be described in closer detail by means of two embodiments and with reference to the accompanying drawing in which.

DETAILED DESCRIPTION OF THE INVENTION

Figure 1:
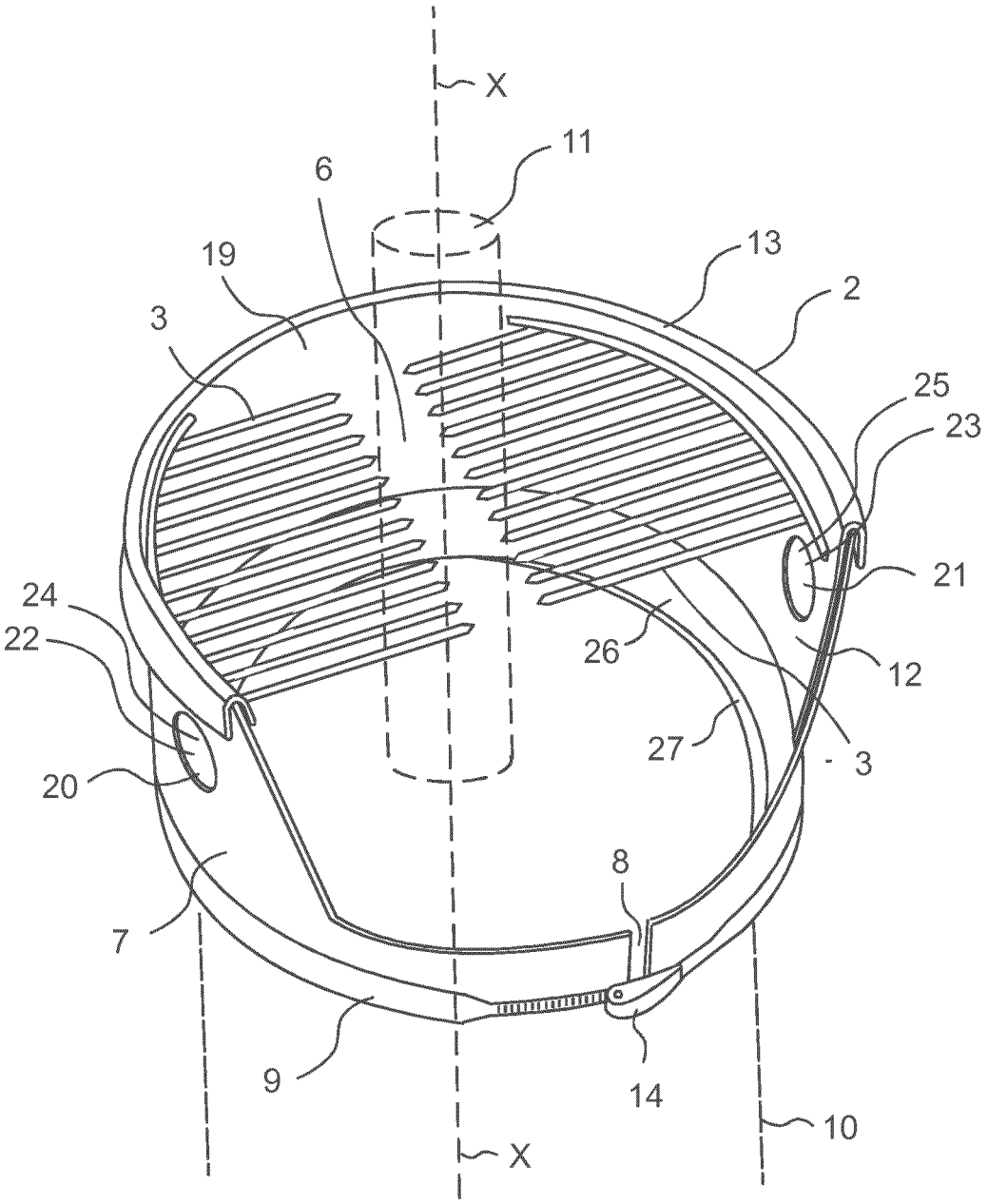
FIG. 1 shows the first embodiment of the chopping aid device mounted on a chopping block.

In FIG. 1 the chopping aid device is shown mounted on top of a chopping block 10 drawn with broken line. The chopping aid device has been tightened around the chopping block with a buckle or straining strap 9. The chopping aid device lies with a bead 27 on the upper surface of the chopping block 10. The bead 27 prevents wood debris from being accumulated in possible gaps between the chopping block 10 and the chopping aid device. It is, however, possible to lower the chopping aid device from the position shown in FIG. 1 to a position where the bead 27 encircles the chopping block 10 by first moving it downwards in the vertical direction and thereafter tightening the straining strap 9 using the tightening and locking device 14 of the straining strap. Such lowering may be desirable in order to provide good support for very short logs to be chopped. For reasons of simplicity, in the figure only one wood 11 to be chopped has been drafted.

As illustrated in FIG. 1, the woods are placed vertically within the chopping aid device. A plurality of flexible spikes 3 support the wood 11 to be chopped. The spikes have a diameter of e.g. 1 to 2 mm, but the diameter can vary much depending on the material of the spikes, the size of the logs to be split, etc. If very thin spikes 3 are used (diameter 1 mm or less), the spikes can be called bristles. When the wood 11 is positioned within the chopping aid device, the spikes 3 adjacent the wood bend downwards thus providing a lateral force on the wood. By bending downwards, the risk of cutting or damaging in another way the spikes with an axe, is also reduced. The lateral force of the spikes 3 supports the wood and ensures that the wood 11 is positively kept upright within the chopping aid device even if the cross-section of the wood supporting the wood from below does not, as such, provide adequate support owing to the reason that it is not at right angles to the longitudinal axis of the wood. Thanks to the spikes 3, the wood 11 is positively kept upright before it is hit with an axe (not shown) and also after it has been split with the axe. The next hit with the axe can immediately be carried out without an intermediate need to touch the wood.

The chopping aid device comprises a basket-like cylindrical cuff frame 1 made of flexible elastomeric material, e.g. rubber, Thermo Plastic Elastomer (TPE), Polypropylene (PP) or Polyethylene (PE). The bottom 5 of the cuff frame 1 is arranged around the upper end of the chopping block 10. The cuff frame 1 is circumferentially open having a peripheral wall 26 which is non-continuous by comprising a slot 8 at the front side or user side. The slot 8 enables to easily adjust the diameter of the bottom of the cuff frame 1 making it easy to position the cuff frame around chopping blocks 10 of different size. By tightening the straining strap 9, the cuff frame 1 will steadily be fastened to the chopping block 10. The diameter of the cuff frame 1 is preferably about 400 mm. Such a cuff frame can easily be fastened to chopping blocks 10 having diameters between 300 to 500 mm.

Because the cuff frame 1 is resilient, it will dampen the impact on the chopping aid device if the device is accidentally hit on by the axe. To protect the cuff frame 1 form being damaged by an accidental hit, a cylindrical collar 7 has been mounted on top of the cuff frame 1. The collar 7 is made of a harder material than the cuff frame 1, e.g. from polyamide (nailon) Glassfiber reinforced Polyamide (PA) or Glassfiber reinforced Polybutylene terephthalate (PBT). The collar 7 distributes the force of the accidental hit to a large area of the cuff frame 1 thus preventing the blade of the axe to cut into the cuff frame 1. Even a relatively strong hit on the collar 7 will not damage the collar, because the cuff frame 1 under the collar dampens effectively the hit.

Figure 2:
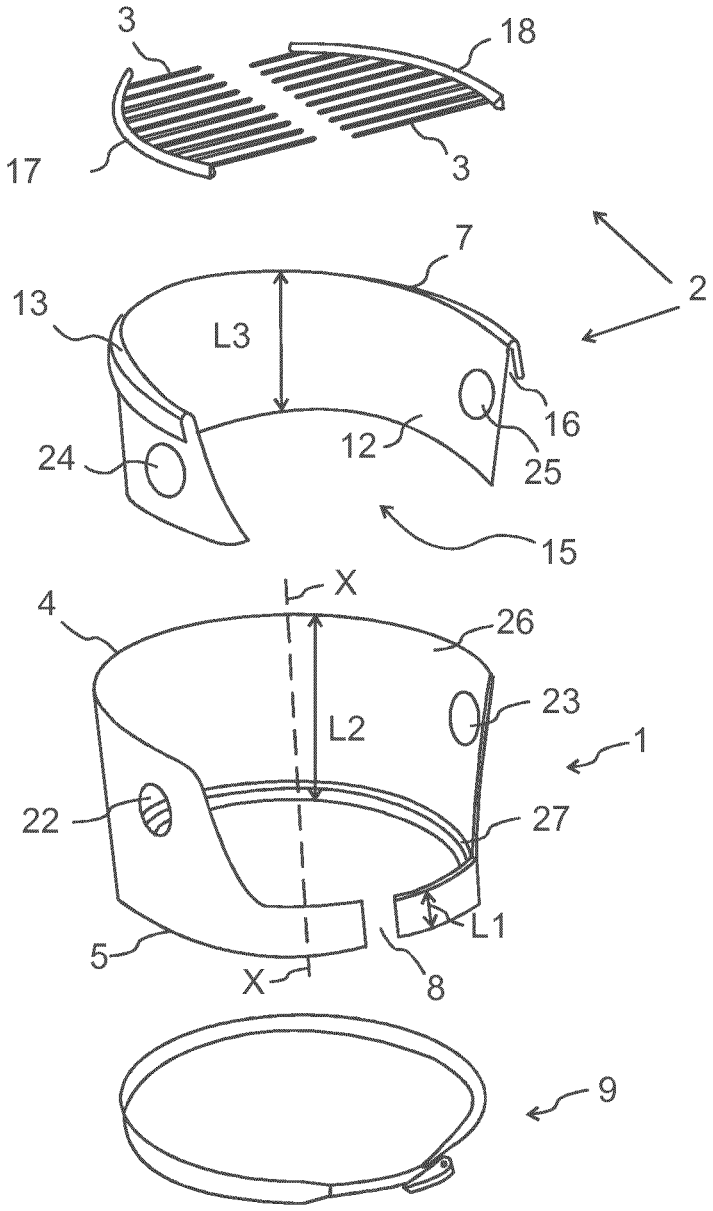
FIG. 2 shows the chopping aid device of FIG. 1 in an exploded view.

FIG. 2 shows the components of the chopping aid device of FIG. 1. The device comprises a cylindrical collar 7 to be mounted on top of the cuff frame 1. The spikes 3 are detachably attached to the collar 7 in order to make replacement of worn and damaged spikes easy. Thus the spikes 3 are indirectly, by means of the collar 7 fastened to the cuff frame 1. The spikes 3 and the collar 7 together form a support 2 to keep the wood 11 to be chopped upright and also to keep the chopped firewood upright. The collar 7 is made of flexible material. The spikes 3 are horizontal with respect to the collar 7 and the cuff frame 1.

The distance from the bottom 5 of the cuff frame 1 to the upper edge 4 of the frame varies in such a way that the distance L1 at the front side or user side of the chopping aid device is much smaller than the distance L2 at the rear side of the chopping aid device, or at any other direction which differs from the front side. In this way the cuff frame 1 is open at the front side. The opening at the front side of the cuff frame 1 gives space for the handle of the ax (not shown) when firewood is chopped and makes it easy to clean the upper surface of the chopping block 10 from wood debris. The distance L2 is preferably about 200 mm. The distance L1 can be e.g. 20-50 mm.

The collar 7 has a peripheral wall 12 which is non-continuous so that it comprises a peripheral opening 15. When the collar 7 is put on top of the cuff frame 1, the opening 15 of the collar 7 is aligned with the front side of the cuff frame 1. The opening 15 (like the opening of the cuff frame 1) gives space for the handle of the axe when firewood is chopped.

The collar 7 is detachably fastened to the cuff frame 1. For this purpose the upper edge 13 of the collar 7 comprises a groove 16 to receive the upper edge 4 of the cuff frame 1. The height L3 of the collar 7 must be less than the height L2 of the cuff frame 1 because the collar 7 must not hit the upper end of the chopping block 10 if the axe accidentally hits on the collar. If the distance L2, i.e. the maximum height of the cuff frame 1 is about 200 mm, the height L3 of the collar 7 is preferably 150-180 mm. In normal use of the chopping aid device, the collar 7 is fastened to the cuff frame 1 in such a way that the opening 15 thereof faces the user, c.f. FIG. 1. However, the collar 7 can alternatively be positioned on the cuff frame 1 in such a way that the opening 15 thereof is diametrically opposite to the opening of the cuff frame 1.

Such a positioning of the collar 7 gives as result a chopping aid device having fully closed walls and no opening facing the user. Fully closed walls and detached spikes 3 allow to easily fill up the whole cross-section of the chopping aid device with woods. Because the collar 7 can be rotated 0 to 180 degrees with respect to the cuff frame 1, it can be positioned on top of the cuff frame 1 so that the opening 15 thereof points at any desired direction.

The spikes 3 have been fastened at two arcs 17, 18 which, in turn, are detachably fastened to the collar 7, e.g. by snap-fasteners, which can be of pin-hole type.

As can be seen from FIGS. 1 and 2, the spikes 3 are directed horizontally to a longitudinal axis X-X of the cuff frame1. The spikes 3 are fastened at opposite sides of the collar 7 so that two rows of spikes 3 are formed. The spikes 3 of one row are directed against the spikes 3 in the other row leaving between the free ends, i.e. between the tips of the spikes of respective row, a narrow slot-like zone 6 which is free of spikes. The width of the zone 6, against which the free ends of the spikes 3 are directed, is 10 to 50 mm. The zone 6 is directed against the user and the spikes 3 are at right angles to the user.

Thanks to said arrangement of the spikes 3, the spikes 3 effectively prevent the wood from moving against the user when the wood is chopped and they also prevent the wood from collapsing within the cuff frame 1. Also, the spikes 3 are short enough (shorter than the height of the chopping aid device) so that the tips thereof do not reach the upper surface of the chopping block 10 when they are bent downwards. Owing to this, the spikes cannot be cut by being pinched between the axe and the upper surface of the chopping block 10 The angle of the spikes 3 in relation axis X-X and to the front side of the chopping aid device, and the user, does not have to be a right angle; however, an obtuse angle with respect to the front-rear-line of the chopping aid device is preferred.

To make the chopping aid device easier to manufacture and also to avoid charging of logs too close to the margins of the chopping aid device, in which case the risk of mishits including hits on the edge of the chopping aid device increases, there is also at the rear side of the chopping aid device a segment 19 free of spikes as seen from FIG. 1. The front side of the chopping aid device has a similar segment (however, not shown by reference numeral) free of spikes. The spikes 3 cover at least 70% of the cross-sectional area of the cuff frame 1. In said figure of 70% not only the total projection area of the individual spikes 3 but also the areas of the gaps between adjacent spikes are included.

The chopping aid device comprises handles 20, 21 in order to make it easy to lift and move. The handles 20, 21 are formed of holes 22, 23 and 24, 25 made in the cuff frame 1 and collar 7, respectively. The holes 22 and 23, like the holes 24 and 25 are preferably spaced 180 degrees apart. The holes 23 to 25 are not, however, indispensable as the chopping aid device is not heavy.

Figure 3:
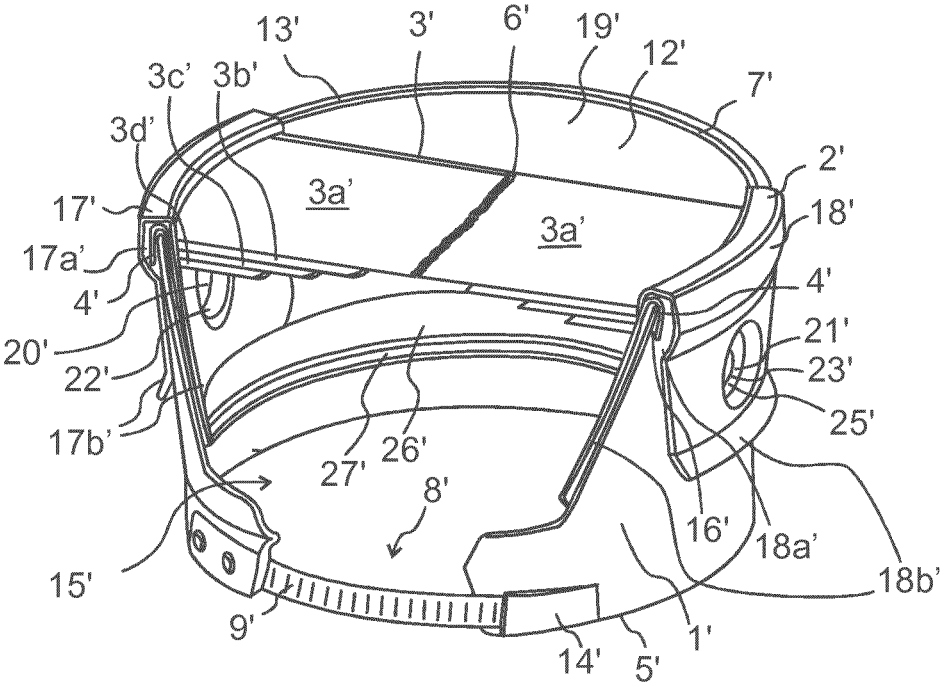
FIG. 3 shows the second embodiment of the chopping aid device.

FIG. 3 shows another embodiment of the chopping aid device. In FIG. 3 has been used similar reference numerals as in FIG. 1 for corresponding components. For the sake of simplicity only one spike 3' has been separately drafted in FIG. 3 although the number of spikes in the support 2' is large, like in the embodiment of FIG. 1.

The embodiment of FIG. 3 differs from the embodiment of FIG. 1 in that the spikes 3' are arranged in four levels 3*a*', 3*b*', 3*c*', 3*d*'. The length of the spikes 3' in the different levels 3*a*', 3*b*', 3*c*', 3*d*' diminishes in the direction downwards so that the average length of the spikes in a lower level, e.g. level 3*c*', is shorter than the average length of the spikes in an upper level, 3*b*' or 3*a*'. Such an arrangement of the spikes 3' has the advantage that it provides better support for the woods to be chopped by adding more progressive support force when more wood is added and prevents the creeping and permanent deflection of longer spikes by supporting them from underneath with shorter spikes which are less prone to creepage and deflection caused by gravity.

Figure 4:
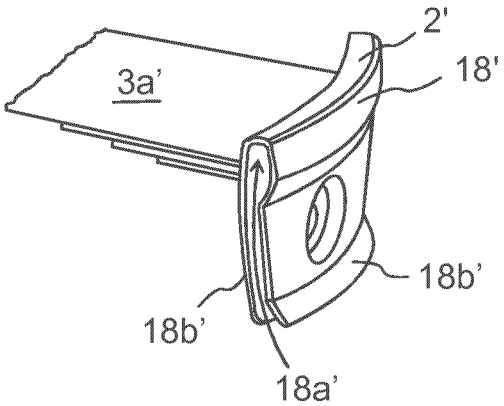
FIG. 4 shows a detail of the chopping aid device of FIG. 3.

The embodiment of FIG. 3 differs from the embodiment of FIG. 1 further in that the spikes 3' are fastened to arcs in the form of holders 17', 18' which are fastened to the collar 7' by means of grooves 17*a*', 18*a*'. The holders 17', 18' also comprise branches 17*b*', 18*b*' the lower edge of which press against the cuff frame 1 and the collar 7. From FIG. 4, which shows the holder 18' separately from the support 2', the groove 18*a*' is clearly seen. In FIG. 3 the groove 18*a*' receives the upper edge 13' of the collar 7'. The advantage of the groove 18*a*' is that the holder 18' is easy to position in place on the collar 7' and remove from the collar 7'. The holders 17', 18' of the embodiment of FIG. 3 also make it very easy to position the spikes 3 of two holders 17', 18' in such a way that the spikes 3' are in line regardless variations in diameter of the chopping block.

Still further the embodiment of FIG. 3 differs from the embodiment of FIG. 1 in that the width of the zone 6' free of spikes is negligible small.

The invention has been described above only by two examples. It shall be understood that the invention can be implemented in many ways within the scope of the attached claims. Hence, it is for instance possible that the frame of the chopping aid device is not a basket-like cuff frame but a frame which is formed of e.g. two oppositely positioned walls and having two major openings between the walls. If a basket-like cuff frame is used, the cuff frame can have a geometrical form which is not cylindrical: the cross-section of the device can be elliptic or square. However, a cylindrical form is preferable, because a cylindrical cuff frame is easy to position on top of a chopping block. The bead in the inner wall of the cuff frame 1 is not indispensable, but is highly preferable, because it gives stability to the chopping aid device. The chopping aid device, however, can be used without an ordinary chopping block: it can be positioned on a firm base which provides the required support for chopping woods. In such a situation the cross-section of the chopping aid device can very well be for instance rectangular, in which case no straining strap is needed. The zone 6 in the central area of the cross-section of the cuff frame 1 need not have the form of a slot; it can e.g. have the form of a circle or some other form. Further, deviating from what has been disclosed in the two embodiments, it is possible to implement the chopping aid device by integrating the support (c.f. support 2, 2') with the cuff frame (c.f. cuff frame 1, 1'). This can e.g. be carried out by two component molding. The support is injection molded of a material providing a support durable against cuts, and the cuff frame is, in the same injection molding machine, injection molded of a material providing a cuff frame which is flexible and resilient.

The invention claimed is:

1. A chopping aid device for use in chopping of firewood, the chopping device comprising:

a cuff frame with a peripheral wall to prevent pieces of wood to spread into the surroundings outside the chopping aid device during chopping, the peripheral wall is circumferentially open by comprising a slot enabling adjustment of a bottom diameter of the cuff frame around an upper end of a chopping block to which the chopping block is fastened during chopping, and a support comprising a plurality of flexible spikes which are directed at least substantially horizontally within the frame and which bend to provide a lateral force to keep firewood in an upright position within the frame when firewood is positioned within the chopping aid.

2. A chopping aid device according to claim 1, wherein the frame is a basket-like cuff frame.

3. A chopping aid device according to claim 1, wherein the frame comprises an upper edge whose distance from a bottom of the frame is smaller at the front side or user side than the distance from the bottom at a side which differs from the front side.

4. A chopping aid device according to claim 1, wherein the frame is open at the front side or user side.

5. A chopping aid device according to claim 1, wherein the frame is circumferentially open having a peripheral wall which is non-continuous by comprising a slot is at the front side.

6. A chopping aid device according to claim 1, wherein first ends of the spikes which are opposite to free ends of the spikes are attached to the support.

7. A chopping aid device according to claim 1, wherein the spikes comprise first ends which are fastened to a collar which is circumferentially open having a peripheral wall which is non-continuous having a peripheral opening, and which collar is detachably fastened to the frame so that the peripheral opening is aligned with the front side of the frame.

8. A chopping aid device according to claim 7, wherein the spikes are detachably fastened to the collar.

9. A chopping aid device according to claim 7, wherein the spikes are detachably fastened to the collar via a holder having a groove for receiving an upper edge of the collar.

10. A chopping aid device according to claim 7, wherein the frame is cylindrical and in that the collar is cylindrical.

11. A chopping aid device according to claim 1, wherein the frame comprises an inner wall with a lower region that comprises a circular bead.

12. A chopping aid device according to claim 7, wherein the collar is rotatable with respect to the frame.

13. A chopping aid device according to claim 7, wherein the frame is flexible and made of elastomeric material and in that the collar is made of harder material than the frame.

14. A chopping aid device according to claims 1, wherein a straining strap attached to a bottom of the frame for adjusting the diameter of the bottom of the frame.

15. A chopping aid device according to claim 1, wherein the spikes are directed at least substantially at right angles to a longitudinal axis of the frame.

16. A chopping aid device according to claim 1, wherein at least the greater part of the cross-sectional area of the frame is covered by the spikes of the support.

17. A chopping aid device according claim 1, wherein the spikes are directed at an obtuse angle with respect to a front-rear-line of the chopping aid device.

18. A chopping aid device according to claim 1, wherein a cross-sectional area of the frame is free of spikes at an area which is at the front side of the frame.

19. A chopping aid device according to claim 18, wherein the cross-sectional area is a segment.

20. A chopping aid device according to claim 1, wherein the support comprises spikes arranged in a plurality of levels in which the length of the spikes in a lower level is shorter than the length of the spikes in an upper level.

* * * * *